US005403171A

United States Patent [19]

Sugita et al.

[11] Patent Number: 5,403,171

[45] Date of Patent: Apr. 4, 1995

[54] SCROLL COMPRESSOR

[75] Inventors: Tatsuya Sugita; Takashi Yamamoto; Kenji Suzuki; Hiroshi Ogawa, all of Shizuoka, Japan

[73] Assignee: Mitsubishi Denki Kabushiki Kaisha, Tokyo, Japan

[21] Appl. No.: 187,499

[22] Filed: Jan. 28, 1994

[30] Foreign Application Priority Data

May 7, 1993 [JP] Japan ..... 5-106895

[51] Int. Cl.[6] ..... F01C 1/04

[52] U.S. Cl. ..... 418/55.1; 418/151

[58] Field of Search ..... 418/55.1, 151

[56] References Cited

U.S. PATENT DOCUMENTS 4,898,520 2/1990 Nieter et al. ..... 418/55.1
5,174,738 12/1992 Baumann et al. .

FOREIGN PATENT DOCUMENTS 0317270 5/1989 European Pat. Off. .
0284983 12/1987 Japan ..... 418/151
4-84784 7/1992 Japan .

OTHER PUBLICATIONS

Patent Abstracts of Japan, vol. 16, No. 282 (M-1269), Jun. 23, 1992, JP-A-04 072 484, Mar. 6, 1992.

Patent Abstracts of Japan, vol. 16, No. 446 (M-1311), Sep. 17, 1992, JP-A-04 153 587, May 27, 1992.

Patent Abstracts of Japan, vol. 11, No. 392 (M-653) [2839], Dec. 22, 1987, JP-A-62 159 783, Jul. 15, 1987.

*Primary Examiner*—Richard A. Bertsch
*Assistant Examiner*—Charles G. Freay
*Attorney, Agent, or Firm*—Oblon, Spivak, Mcclelland, Maier & Neustadt

[57] ABSTRACT

In a scroll type compressor, the cylindrical surface of the auxiliary shaft 5c is eccentric from the cylindrical surface of the main shaft 5b and the cylindrical surface of the rotor shaft 5d, in such a manner that the amount of eccentricity thereof satisfies the following condition: 1/10000<(amount of eccentricity)/(bearing span)<20/10000, and the direction of eccentricity thereof is in a range of from 0° to 40° in the direction of the centrifugal force of the upper balance weight 8 with respect to the direction in which the crank section 5a receives a gas compression load, and the main shaft 5b has an initial angle of relative inclination opposite to the angle of inclination which is formed by the gas pressure load and the centrifugal load of the balance weight. During the operation of the compressor, the load deflection angle and the initial deflection angle are canceled out by each other, so that the main bearing 3a and the main shaft 5b are held in parallel with each other. As a result, the input is decreased, and the shaft is scarcely worn, and is prevented from seizure.

6 Claims, 11 Drawing Sheets

DIRECTION OF COMBINED FORCE OF FN REVERSE VECTOR AND Fc IN A RANGE FROM 15Hz TO 200Hz

SCROLL COMPRESSOR

BACKGROUND OF THE INVENTION

This invention relates to a scroll compressor for a refrigerating operation and an air-conditioning operation.

FIG. 14 is a vertical sectional view of a scroll compressor disclosed by Unexamined Japanese Utility Model Publication Hei-4-84784(U). In FIG. 14, reference numeral 1 designates a stationary scroll having a spiral section 1*a* formed in the lower end face, the stationary scroll 1 being connected to a frame 3 with bolts; and 2, an orbiting scroll having a spiral section 2*a* formed in the upper end face which is equal configuration to the spiral section 1*a* of the stationary scroll 1, and a hollow boss section 2*b* extended from the lower end surface. An orbiting bearing 2*c* is formed on the inner surface of the hollow boss section 2*b*.

Further in FIG. 14, reference numeral 5 designates a crank shaft the upper end portion of which is formed into a cylindrical crank section 5*a* which is eccentric from the axis. The cylindrical crank section 5*a* is rotatably engaged with the orbiting bearing 2*c*. The crank shaft 5 is made up of a main shaft section 5*b* and an auxiliary shaft 5*c*. The cylindrical surfaces of the main shaft section 5*b* and the auxiliary shaft section 5*c* are rotatably supported by a main bearing 3*a* formed on the frame 3 and an auxiliary bearing 4a formed on a subframe 4, respectively.

The crank shaft 5 further includes a rotor shaft section 5*d*, on which a rotor 6 is mounted by shrinkage fitting. The rotor 6 and a stator 7 form a motor section.

In order to balance the centrifugal force of the orbiting scroll 2, an upper balance weight 8 and a lower balance weight 9 are mounted on the crank shaft 5.

When current is applied to the stator 7, the torque is transmitted to the crank shaft 5; that is, the torque is transmitted through the crank section 5*a* to the orbiting scroll 2, to cause the latter 2 to perform an orbiting motion to vary the volume of the compressing chamber defined by the orbiting scroll 2 and the stationary scroll 1. That is, the compressor performs a compressing action.

The crank shaft 5 is supported by the main bearing 3*a* and the auxiliary bearing 4*a* which are provided on both sides of the rotor 6. The crank shaft 5, in turn, supports a gas load applied to the crank section 5*a* by the compressing action, and the centrifugal forces of the upper and lower balance weights 8 and 9. (Hereinafter, the centrifugal force of the lower balance weight 9 will be disregarded, being extremely small).

Now, the crank shaft 5 will be described in more detail. FIG. 15 shows the crank shaft 5 to which no load is applied, while FIG. 16 shows the crank shaft 5 to which a load is applied.

When the compressor is in operation, a gas compression load $F_N$ acts on the crank section 5*a*, a main shaft reaction force $F_1$ from the main bearing 3*a* is applied to the cylindrical surface of the main shaft section 5*b*, and an auxiliary shaft reaction force $F_2$ from the auxiliary bearing 4*a* is applied to the cylindrical surface of the auxiliary shaft 5*c*. That is, in the crank shaft section 5, those three forces $F_N$, $F_1$ and $F_2$ are balanced with one another.

The crank shaft 5, being elastic, is bent by those three forces; that is, the crank shaft 5 is relatively greatly inclined with respect to the main bearing 3*a* and the auxiliary bearing 4*a*.

FIG. 17 shows a compressor disclosed by Unexamined Japanese Patent Publication (Kokai) Sho-64-87890, and in its specification there is an expression "—being made eccentric from each other in the bearing gap between the main bearing 3*a* and the main shaft 5—". However, as is seen from comparison of FIGS. 17 and 14, those compressors are completely different in structure. In the compressor shown in FIG. 17, the main bearing 3*a* and the auxiliary bearing 4*a* are arranged adjacent to each other, and rolling bearings large in radial gap are generally employed. The object of the structure is based on the fact that the main shaft is tilted as much as the radial gap as shown in FIGS. 18 and 19

On the other hand, in the compressor of FIG. 14, the rotor 6 is provided between the main bearing 3*a* and the auxiliary bearing 4*a*; that is, those bearings 3*a* and 4*a* are spaced from each other. Since the bearings 3*a* and 4*a* are not adjacent to each other, the elastic deformation of the crank shaft 5 cannot be disregarded. As described with respect to the object, the angle of relative inclination of the main shaft 5*b* and the main bearing 3*a* is large, thus raising a problem. If summarized, the compressor shown in FIGS. 14 is different from the compressor shown in FIG. 17 in the problems encountered, in structure, and in the means for solving the problems.

The conventional scroll type compressor is constructed as described above. That is, since the angle of relative inclination of the main shaft section 5*b* and the main bearing 3*a* is large, no sufficiently large load capacity is provided. Furthermore, as for the main bearing 3*a* , the angle of relative inclination and the magnitude of the load are both severe in allowance. Therefore, in the compressor, metal contact may occur to increase the input, advance the wearing of the shaft, and seize the shaft. Thus, the compressor is low in reliability, and suffers from a difficulty that it is large in power consumption.

SUMMARY OF THE INVENTION

Accordingly, an object of this invention is to eliminate the above-described difficulties accompanying a conventional scroll type compressor. More specifically; (1) a first object of the invention is to provide a scroll type compressor in which, during operation, the angle of relative inclination of the main bearing 3*a* and the main shaft section 5*b* is small, the mechanical loss on the main bearing 3*a* is less, and the bearings are high in reliability; (2) a second object of the invention is to provide a scroll type compressor in which, during operation, the angle of relative inclination of the main bearing 3*a* and the main shaft section 5*b* is small, the mechanical loss on the main bearing 3*a* is less, and the bearings are high in reliability, and in which the difficulty is substantially eliminated that electromagnetic sounds are produced by the imbalance between the rotor shaft section 5*d* and the stator 7; and (3) a third object of the invention is to provide a scroll type compressor in which, during operation, the angle of relative inclination of the main bearing 3*a* and the main shaft 5*b* is small, the mechanical loss on the main bearing 3*a* is less, and the bearings are high in reliability, and in which, even when the angle of relative inclination of the main bearing 3*a* and the main shaft section 5*b* becomes large, the mechanical loss on the auxiliary bearing 4*a*, and the bearings are high in reliability.

According to the first aspect of the invention, in a scroll type compressor, the cylindrical surface of an auxiliary shaft section 5c is eccentric from the cylindrical surface of a main shaft section 5b and the cylindrical surface of a rotor shaft section 5d, in such a manner that the amount of eccentricity thereof satisfies the following condition: 1/10000<(amount of eccentricity)/(bearing span)<20/10000 where (bearing span) is the distance between the centers of a main bearing 3a and an auxiliary bearing 4a in an axial direction, and the direction of eccentricity thereof is in a range of from 0° to 40° in the direction of the centrifugal force of an upper balance weight 8 with respect to the direction in which a crank section 5a receives a gas compression load, and the main shaft section 5b has an initial angle of relative inclination opposite to the angle of inclination which is formed by the gas pressure load and the centrifugal load of the balance weight.

According to the second aspect of the invention, in the scroll type compressor of the invention, the cylindrical surfaces of the rotor shaft section 5d and the auxiliary shaft 5c are eccentric from the cylindrical surface of the main shaft section 5b, in such a manner that the amount of eccentricity thereof satisfies the following condition: 1/10000<(amount of eccentricity)/(bearing span)<20/10000, and the direction of eccentricity thereof is in a range of from 0° to 40° in the direction of the centrifugal force of the upper balance weight 8 with respect to the direction in which the crank section 5a receives a gas compression load, and the main shaft section 5b has an initial angle of relative inclination opposite to the angle of inclination which is formed by the gas pressure load and the centrifugal force of the balance weight.

Furthermore, in the scroll type compressor of the invention, the above-mentioned eccentric shaft is employed, and a rolling bearing is employed as the auxiliary bearing.

In the scroll type compressor of the first aspect of the invention, as was described above, the cylindrical surface of the auxiliary shaft section 5c is eccentric from the cylindrical surface of the main shaft section 5b and the cylindrical surface of the rotor shaft section 5d, in such a manner that the amount of eccentricity thereof meets the following condition: 1/10000<(amount of eccentricity)/(bearing span)<20/10000, and the direction of eccentricity thereof is in a range of from 0° to 40° in the direction of the centrifugal force of the upper balance weight 8 with respect to the direction in which the crank section 5a receives a gas compression load. Although the crank shaft 5 is inclined with respect to the axis of the main bearing 3a and the auxiliary bearing 4a (those bearings being coaxial) by the loads, the main shaft 5b has an initial angle of relative inclination (corresponding to an initial angle of inclination $\alpha$ in FIG. 1) opposite to the angle of inclination ($\theta$ in FIG. 16) which is formed by the gas pressure load and the centrifugal load of the balance weight. Therefore, during the operation of the compressor, the load deflection angle and the initial deflection angle are canceled out by each other, so that the main bearing 3a and the cylindrical surface of the main shaft 5b are substantially in parallel with each other.

In the scroll type compressor of the second aspect of the invention, the cylindrical surfaces of the rotor shaft 5d and the auxiliary shaft section 5c are eccentric from the cylindrical surface of the main shaft section 5b, and the main shaft 5b has an initial angle of relative inclination opposite to the angle of inclination which is formed by the gas pressure load and the centrifugal load of the balance weight. Hence, during the operation of the compressor, the load deflection angle and the initial deflection angle are canceled out by each other, so that the main bearing 3a and the cylindrical surface of the main shaft section 5b are substantially in parallel with each other, and the difficulty is eliminated that electromagnetic sounds are produced by the imbalance between the rotor shaft section 5d and the stator 7.

Furthermore, in the scroll type compressor, a rolling bearing is employed as the auxiliary bearing 4a. Hence, even in the case where the eccentric shaft of the above-described is used, and the angle of inclination of the auxiliary shaft 5c becomes large, the compressor is maintained high in performance and in reliability, because the rolling bearing is large in the allowable angle of inclination.

DETAILED DESCRIPTION OF PREFERRED EMBODIMENTS

First embodiment of this invention will be described with reference mainly to FIGS. 1 and 2.

Figure 1:
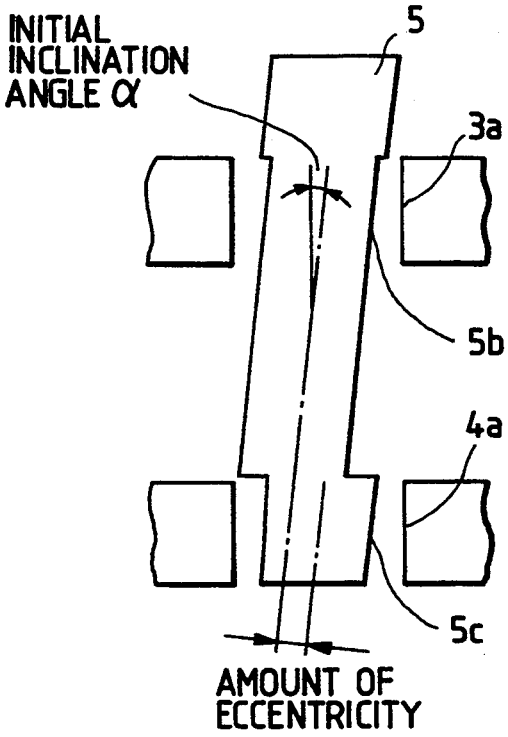
FIG. 1 is an explanatory diagram showing a configuration of a main shaft which is free from a gas compression load and a balance weight centrifugal force.
Figure 2:
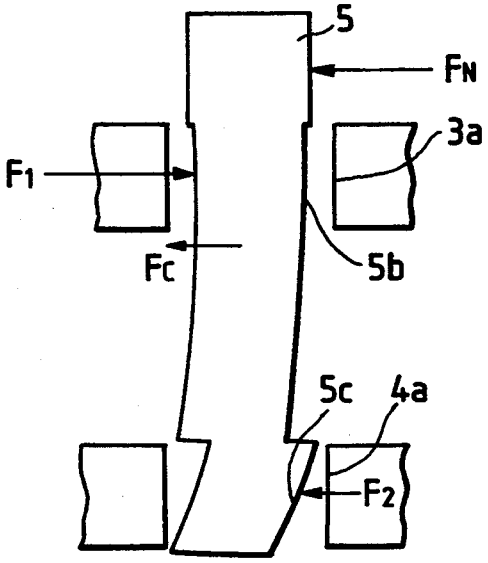
FIG. 2 is an explanatory diagram showing another configuration of the main shift section to which the gas compression load and the balance weight centrifugal force are applied.
Figure 3:
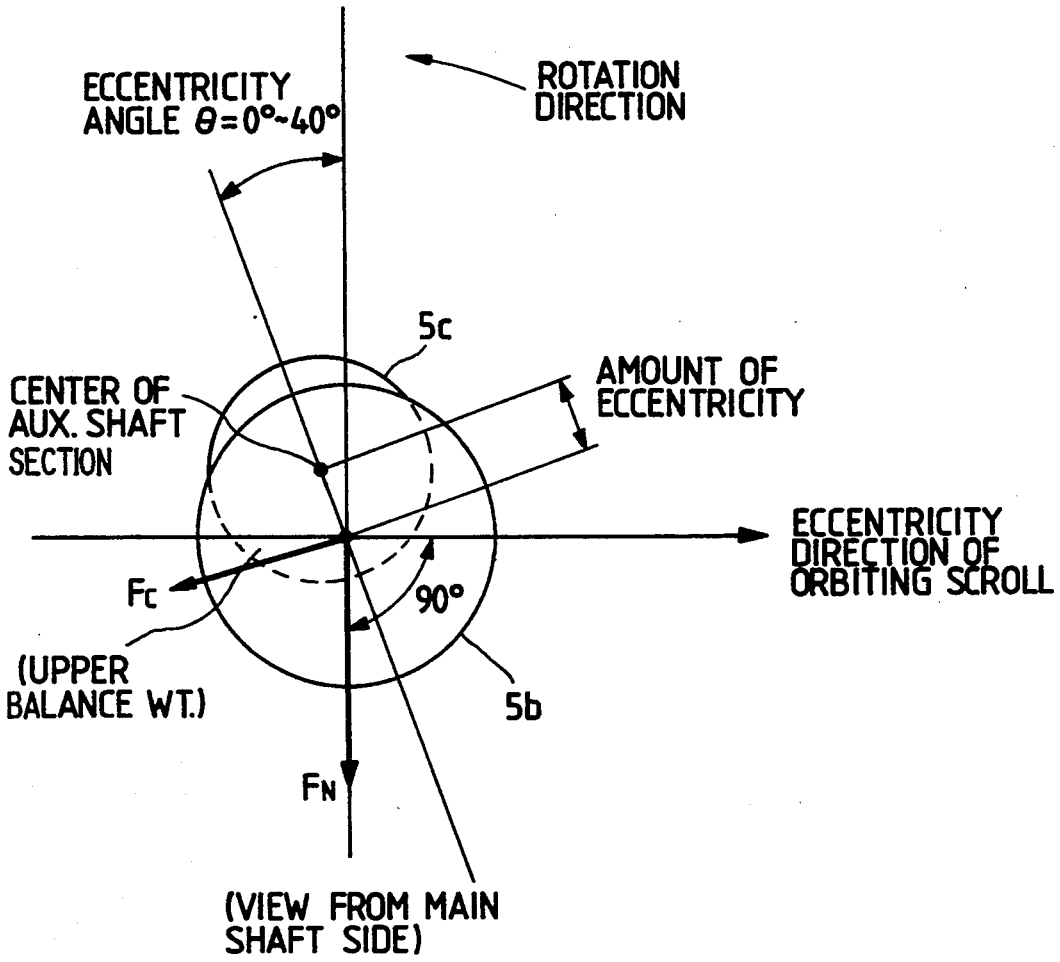
FIG. 3 is an explanatory diagram showing forces applied to the main shaft and the direction of eccentricity.

FIG. 1 shows a configuration of the crank shaft 5 in the scroll type compressor of the invention in an exaggerated way, which shaft is free from a gas compression load $F_N$ and a centrifugal force $F_c$ (because the compressor is not in operation). As with conventional arrangements, a stationary scroll and an orbiting scroll are provided having spiral sections, respectively having opposite winding directions, which define a compressing chamber. FIG. 2 shows another configuration of the crank shaft in an exaggerated way to which the gas compression load $F_N$ and the centrifugal force $F_C$ are applied (because the compressor is in operation). In addition, a main shaft reaction force $F_1$ is applied from the main bearing 3*a* to the cylindrical surface of the main shaft section 5*b*, and an auxiliary shaft reaction force is applied from the auxiliary bearing 4*a* to the auxiliary shaft section 5*c*. FIG. 3 shows positional relationships between a main shaft section 5*b* and an auxiliary shaft section 5*c* which form parts of the crank shaft 5, with the cylindrical surface of the auxiliary shaft 5*c* being eccentric from the cylindrical surface of the main shaft 5*b*. In the scroll type compressor, the centrifugal force of the orbiting scroll 2 is produced in the direction in which the orbiting scroll 2 is off-centered, and the gas compression load $F_N$ (attributing to the gas pressure acting on the orbiting scroll 2) is produced lagging by 90° in phase in the direction of rotation of the crank shaft 5.

As shown in those figures, the cylindrical surface of the main shaft section 5*b* is eccentric from the cylindrical surface of the auxiliary shaft section 5*c*. The main shaft section 5*b* has an initial angle of relative inclination which is opposite to a load deflection angle which is formed by the gas compression load $F_N$ and the centrifugal load $F_C$ of the upper balance weight 8.

Figure 4:
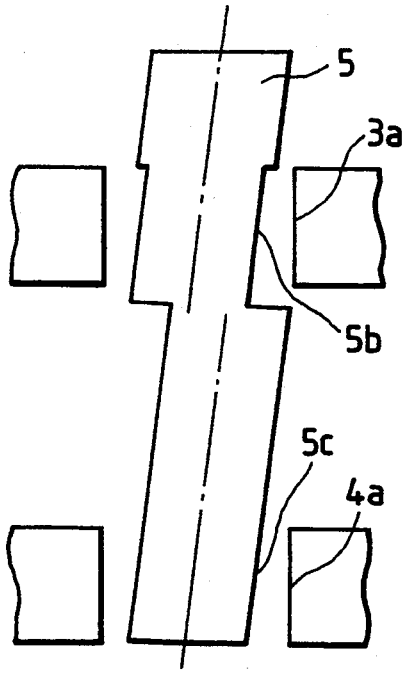
FIG. 4 is an explanatory diagram showing a configuration of the main shaft section of claim 2 which is free from the gas compression load and the balance weight centrifugal force.
Figure 5:
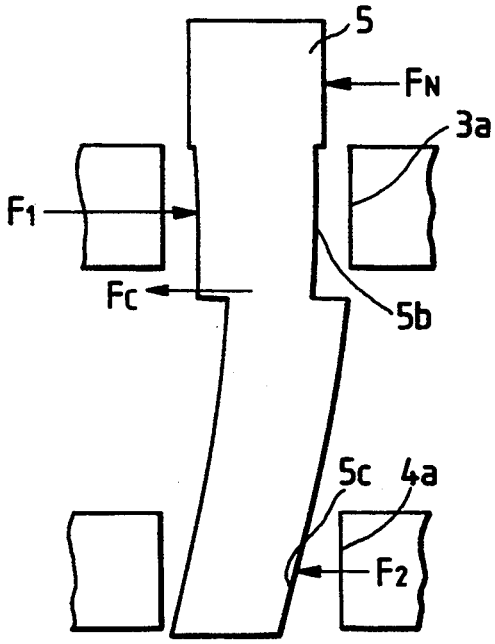
FIG. 5 is an explanatory diagram showing another configuration of the main shaft section of section to which the gas compression load and the balance weight centrifugal force are applied.

Second embodiment of this invention will be described with reference mainly to FIGS. 4 and 5. FIG. 4 shows a configuration of the crank shaft 5 according to the invention in an exaggerated way, to which none of the gas compression load $F_N$ and centrifugal force $F_C$ are applied (in this case, the compressor is not in operation). FIG. 5 shows another configuration of the crank shaft in an exaggerated way to which the gas compression load $F_N$ and the centrifugal force $F_C$ are applied (the compressor is in operation). In addition, the reaction forces $F_1$ and $F_2$ are respectively applied from the bearings 3*a*, 4*a*.

Figure 6:
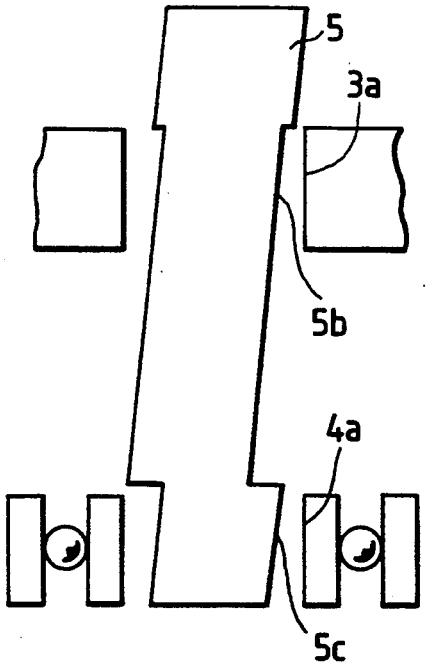
FIG. 6 is an explanatory diagram showing a configuration of the main shaft section which is free from the gas compression load and the balance weight centrifugal force.
Figure 7:
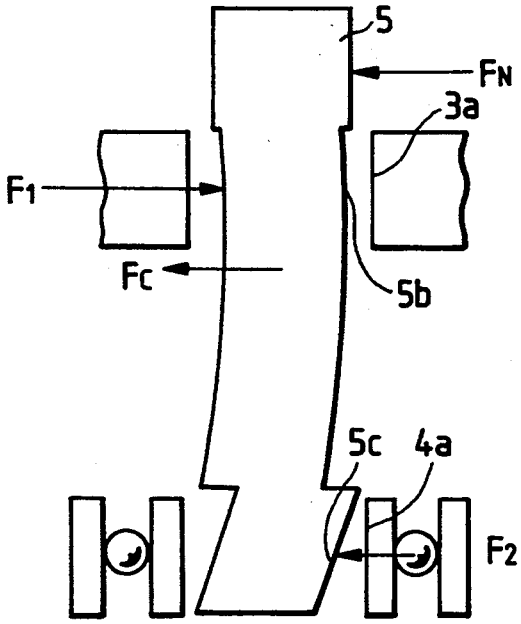
FIG. 7 is an explanatory diagram showing another configuration of the main shaft of section to which the gas compression load and the balance weight centrifugal force are applied.

Third embodiment of the invention will be described with reference mainly to FIG. 6 and 7. FIG. 6 shows a configuration of the crank shaft 5 according to the invention in an exaggerated way, to which none of the gas compression load $F_N$ and centrifugal force $F_C$ are applied (the compressor is not in operation). FIG. 7 shows another configuration of the crank shaft in an exaggerated way to which the gas compression load $F_N$ and the centrifugal force $F_C$ are applied (the compressor is in operation). In addition, the reaction forces $F_1$ and $F_2$ are respectively applied from the bearings 3*a*, 4*a*. In the compressor, the auxiliary bearing 4*a* is a rolling bearing, absorbing the angle of inclination of the auxiliary shaft 5*c*.

Now, the operation of the scroll type compressor according to the invention will be described. In the case of FIG. 1, no gas compression load $F_N$ is applied to the crank shaft 5; and in the case of FIG. 2 the gas compression load $F_N$ is applied to the crank shaft 5. The direction of the gas load $F_N$ turns in synchronization with rotation of the crank shaft 5, and the direction of the centrifugal force of the upper balance weight 8 also turns in synchronization with rotation of the crank shaft 5. That is, as for the crank shaft 5, the direction of the gas load and the direction of the centrifugal force of the upper balance weight 8 are constant at all times.

The crank shaft 5 is bent by the gas load $F_N$ and the centrifugal force $F_C$. However, the bending of the crank shaft is absorbed by the amount of eccentricity and the initial angle of relative inclination which have been given to the crank shaft in advance, so that the main shaft section 5*b* is substantially in parallel with the main bearing 3*a*. Hence, in the compressor, the bearing characteristic is greatly improved; that is, the mechanical loss is decreased, and the bearings are high in reliability.

Figure 8:
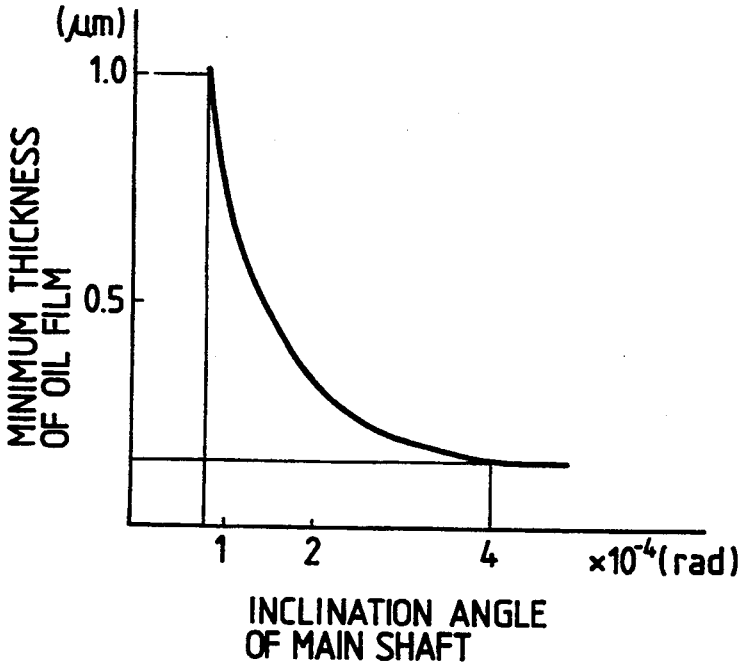
FIG. 8 is a graphical representation indicating the relationships between the angles of inclination of the main shaft section and minimum oil film thicknesses.

FIG. 8 indicates relationships between the angles of inclination of the main shaft section 5*b* and minimum oil film thicknesses. As is apparent from FIG. 8, as the angle of inclination of the main shaft section 5*b* increases, the minimum oil film thickness is extremely greatly decreased, as a result of which metal contact occurs, thus lowering the reliability of the bearings. However, in the compressor of the invention, the eccentric shaft is employed, and therefore the angle of inclination of the main shaft section 5*b* can be decreased, and accordingly the minimum oil film thickness can be improved.

Let us consider the bearing span and the load applied to the shaft in the compressor actually used. That is, the angle of inclination of the main shaft section should be so determined that the ratio of the amount of eccentricity of the shaft to the bearing span, (amount of eccentricity)/(bearing span) satisfies the following conditions:

$$1/10000 < (\text{amount of eccentricity})/(\text{bearing span}) < 20/10000.$$

Figure 9:
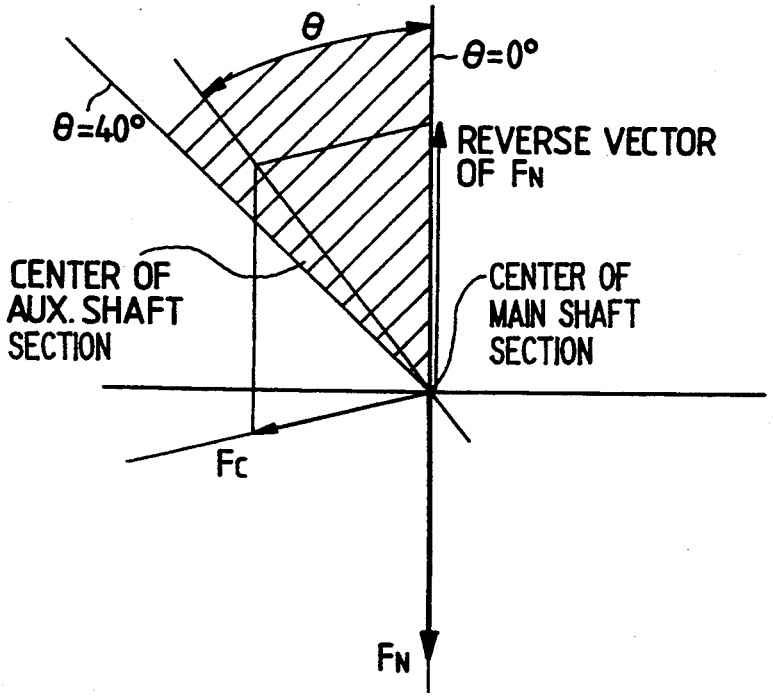
FIG. 9 is a graphical representation indicating the directions of load with the directions of eccentricity.

FIG. 9 shows the directions of forces applied to the shaft with the directions of eccentricity. The gas load $F_N$ and the centrifugal force $F_C$ of the upper balance weight 8 in an actual operating condition that the operating frequency is in a range of from 15 Hz to 200 Hz, are known from. The direction of the composition of $F_N$ and $F'_C$; that is, the direction of eccentricity of the auxiliary shaft section 5*c* is only in a range $\theta$ of from 0° to 40°.

Figure 10:
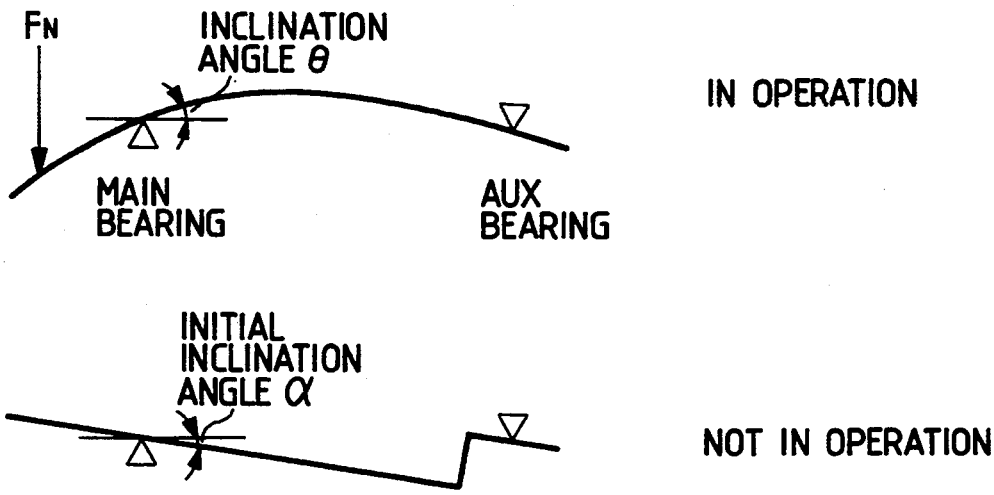
FIG. 10 is an explanatory diagram showing an angle of inclination $\theta$ and an initial angle of inclination $\alpha$ when $F_N$ is produced.
Figure 11:
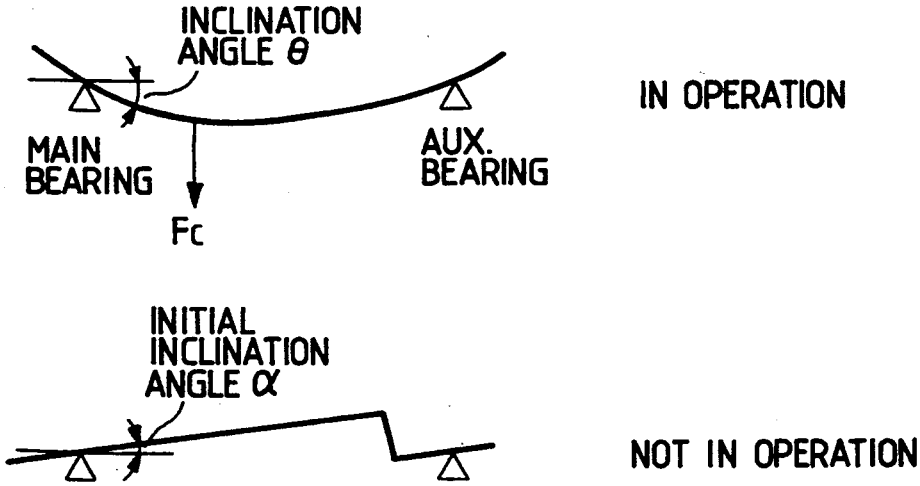
FIG. 11 is an explanatory diagram showing an angle of inclination $\theta$ and an initial angle of inclination $\alpha$ when $F_C$ is produced.

FIGS. 10 and 11 indicate directions of load and directions of eccentricity qualitatively. In the cases where, as shown in FIGS. 10 and 11, the auxiliary shaft section is off-centered in the direction opposite to the direction of the vector of $F_N$ and where it is off-centered in the direction of the vector of $F_C$, in each of the cases the angle of inclination provided when the concentric shaft is in operation is opposite in direction to the initial angle of inclination $\alpha$ provided when the eccentric shaft is not in operation. Therefore, where the eccentric shaft is in operation (not shown), the angle of inclination of the main shaft is canceled nearly to zero (0). Hence, in FIG. 9, the auxiliary shaft is off-centered in the direction of the composition of the inverse vector of $F_N$ and the vector of $F_C$.

Figure 12:
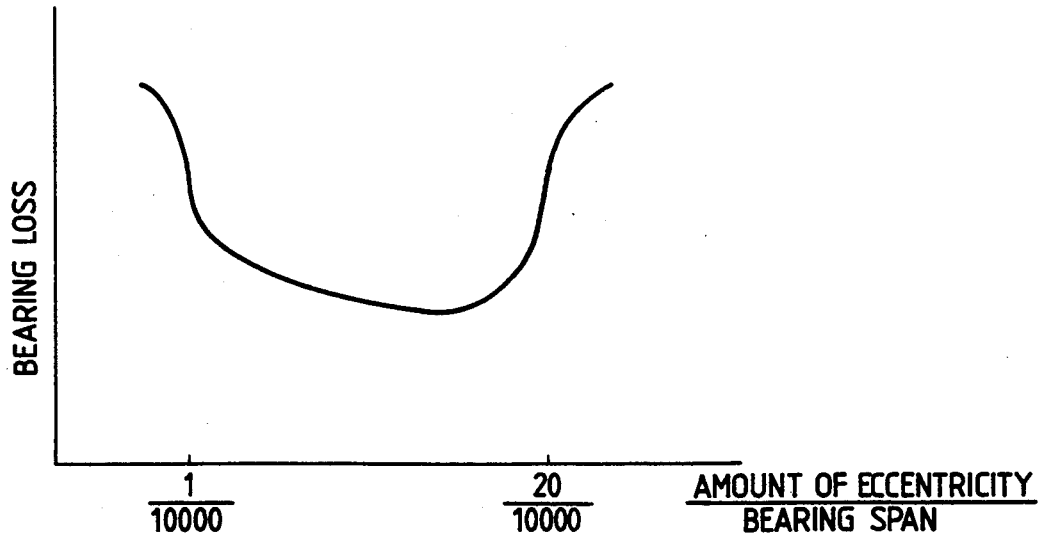
FIG. 12 is a graphical representation indicating (amount of eccentricity)/(bearing span) with bearing loss.
Figure 13:
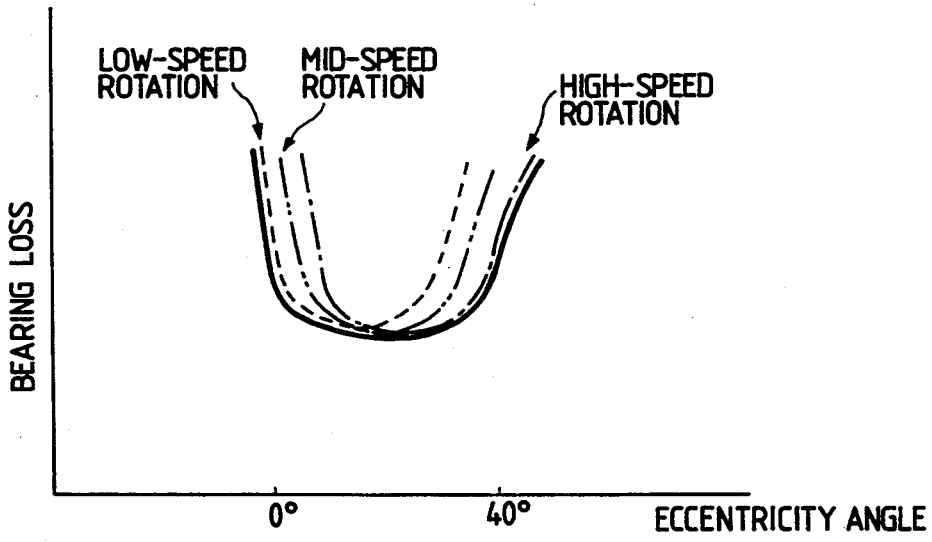
FIG. 13 is a graphical representation indicating eccentric angle with bearing loss.

Tests were performed with the amount of eccentricity and the angle of eccentricity varied. As shown in FIGS. 12 and 13, the amount of eccentricity was in the range defined by [1/1000<(amount of eccentricity)/(bearing span)<20/10000], and the angle of eccentricity, as shown in FIG. 13, was in a range of from 0° to 40°, with the relation between the bearing loss and the angle of eccentricity depending on the speed of rotation. The tests revealed the fact that the bearing loss was greatly decreased when the angle of eccentricity was in the range of from 0° to 40°, although the angle of eccentricity should be selected according to the speed of rotation at which the compressor is mainly operated. Thus, the effect of the first aspect of the invention has been confirmed.

In the case where the eccentric shaft section of the invention is used, the inclination of the main shaft section 5b during operation is improved, and the bearing loss is decreased; however, the inclination of the auxiliary shaft 5c is larger than in the use of a concentric shaft (ordinary shaft). Hence, sometimes it may be a premise condition to use a rolling bearing with which, even when the inclination occurs, the bearing loss is scarcely increased. In general, the allowable angle of inclination of a rolling bearing is 3/10000 (rad). In the case of the eccentric shaft according to the invention, the angle of inclination of the auxiliary shaft section 5c is of the order of 1/10000 (rad), and it can be absorbed by the rolling bearing.

Figure 14:
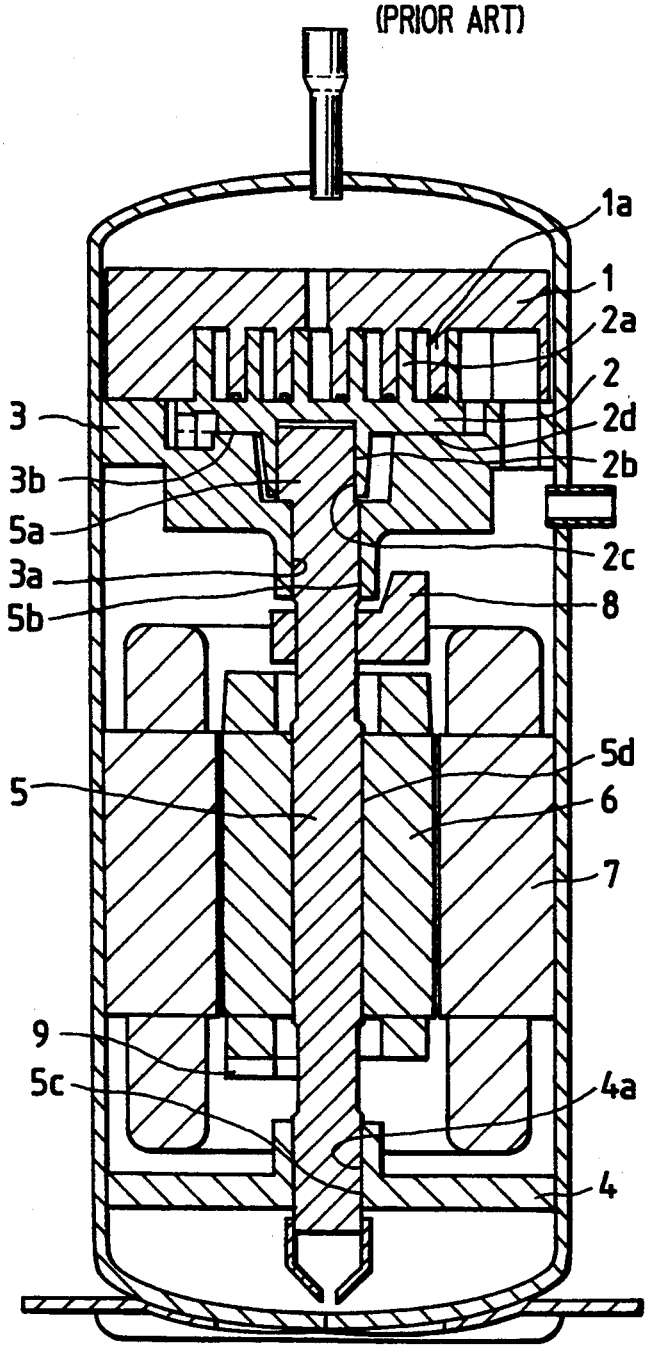
FIG. 14 (PRIOR ART)
FIG. 14 is a sectional view of a conventional scroll type compressor.
Figure 15:
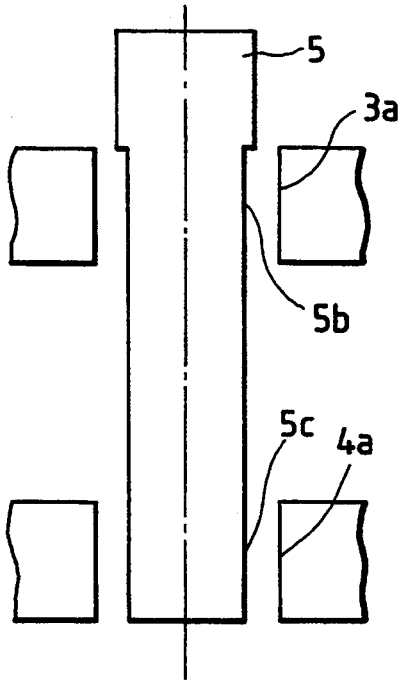
FIG. 15 (PRIOR ART)
FIG. 15 is an explanatory diagram showing a configuration of the main shaft section in the conventional scroll type compressor which is free from a gas compression load and a balance weight centrifugal force.

As is seen from FIG. 14, the compressor is so designed that the upper balance weight 8 is longer in the axial direction than the lower balance weight 9, and therefore the position of the rotor 6 in the axial direction is closer to the auxiliary shaft section 5c than to the main shaft 5b. Therefore, when the auxiliary shaft section 5c is eccentric from the main shaft section 5b and the rotor shaft 5d, the positions of the rotor 6 and the stator 7 in the radial direction are liable to be not balanced, which gives rise to the following difficulties: Electromagnetic sounds are produced, and a magnetic attractive force is induced; that is, the compressor is lowered in performance and in reliability. In order to overcome those difficulties, the rotor shaft section 5d and the auxiliary shaft section 5c are made eccentric from the main shaft section 5b so that the positions of the rotor 6 and the stator 7 in the radial direction are well balanced. Thus, the resultant compressor is high in performance and in reliability.

Figure 16:
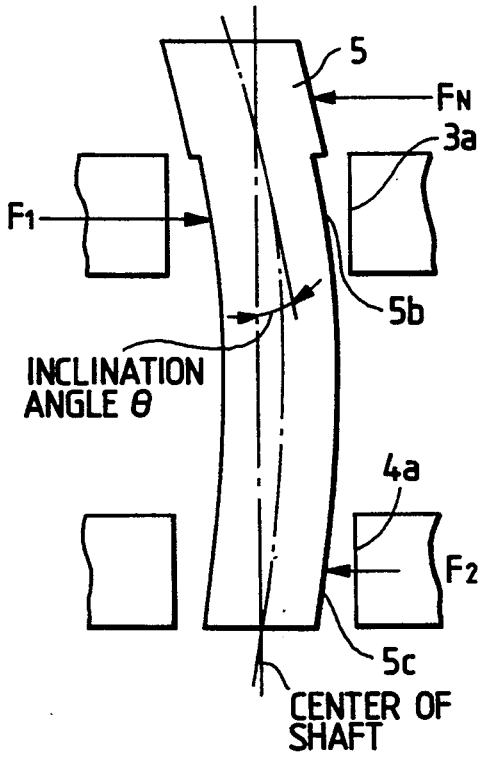
FIG. 16 (PRIOR ART)
FIG. 16 is an explanatory diagram showing another configuration of the main shaft section in the conventional scroll type compressor, to which the gas compression load and the balance weight centrifugal force are applied.
Figure 17:
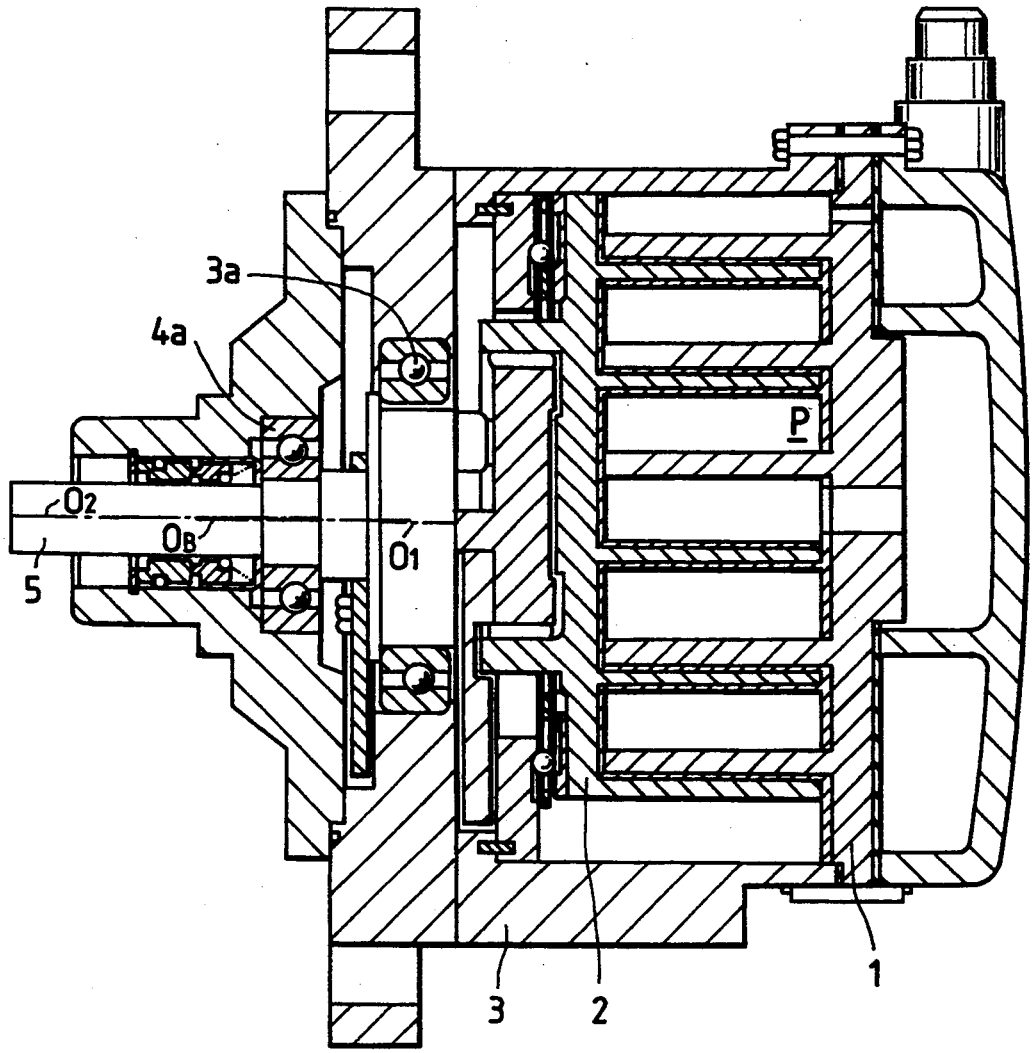
FIG. 17 (PRIOR ART)
FIG. 17 is a sectional view of another conventional scroll type compressor.
Figure 18:
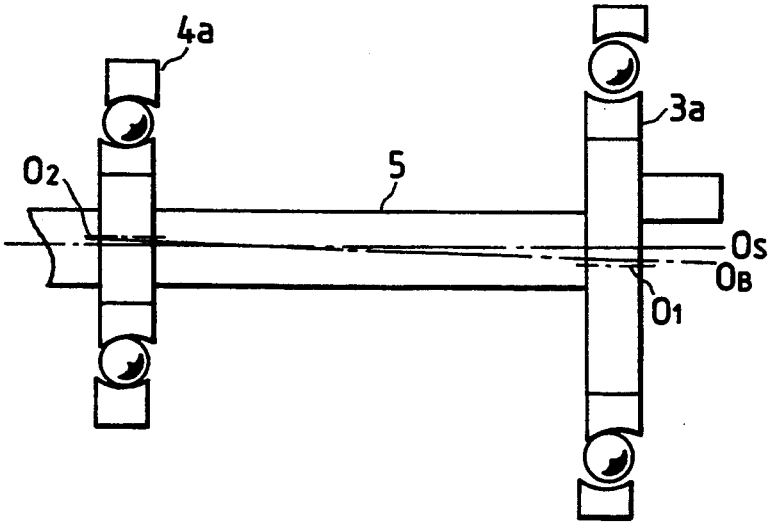
FIG. 18 (PRIOR ART)
FIGS. 18 and 19 are explanatory diagram for a description of the operation of the scroll type compressor shown in FIG. 17.
Figure 19:
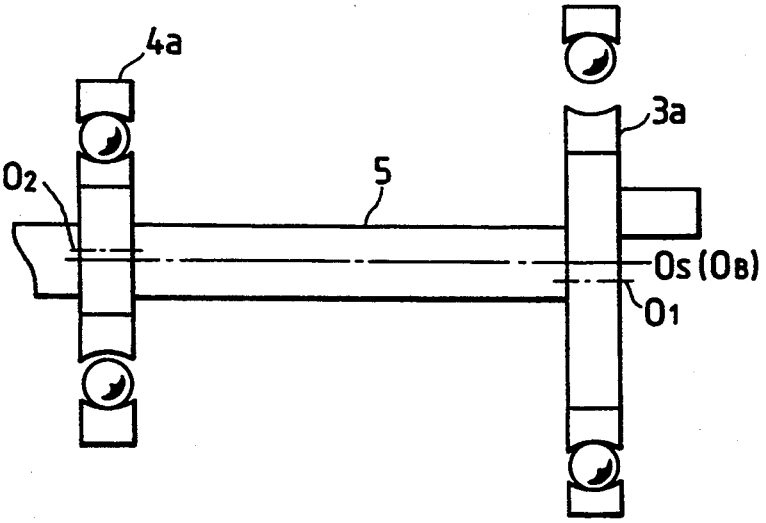
FIG. 19 (PRIOR ART)

As was described above, in the scroll type compressor of the invention, the cylindrical surface of the auxiliary shaft section 5c forming part of the crank shaft 5 is eccentric from the cylindrical surface of the main shaft section 5b in such a manner that the amount of eccentricity thereof meets the following condition: 1/10000<(amount of eccentricity)/(bearing span)<20/10000, and the direction of eccentricity thereof is in a range of from 0° to 40° in the direction of the centrifugal force of the upper balance weight 8 with respect to the direction in which the crank section 5a receives the gas compression load. In addition, the main shaft section 5b has an initial angle of relative inclination (an initial angle of inclination $\alpha$ in FIG. 1) opposite to the angle of inclination ($\theta$ in FIG. 16) which is given by the gas pressure load and the centrifugal load of the balance weight. Therefore, during the operation of the compressor, the load deflection angle and the initial deflection angle are canceled out by each other, so that the main bearing 3a and the cylindrical surface of the main shaft section 5b are substantially in parallel with each other. Therefore, in the compressor, the mechanical loss at the main bearing 3a is less, and the bearings are high in reliability.

What is claimed is:

1. A scroll type compressor comprising:

a stationary scroll and an orbiting scroll which have spiral sections, respectively, which are opposite in winding direction to each other, said spiral sections being combined to define a compressing chamber;

a crank shaft rotated by an electric motor, a rotor of which is fixedly mounted on a rotor shaft section forming part of said crank shaft;

a main bearing and an auxiliary bearing provided above and below said electric motor, said main bearing and auxiliary bearing rotatably supporting a main shaft section and an auxiliary shaft section forming parts of said crank shaft;

upper and lower balance weights arranged above and below said electric motor to balance with a centrifugal force of said orbiting scroll;

said orbiting scroll being driven by an orbiting shaft section forming part of said crank shaft;

wherein a cylindrical surface of said auxiliary shaft section is eccentric from a cylindrical surface of said main shaft section, in such a manner that an amount of eccentricity thereof satisfies the following condition:

1/10000<(amount of eccentricity)/(bearing span)<20/10000 where (bearing span) is a distance between centers of said main bearing and said auxiliary bearing in an axial direction, and a direction of eccentricity thereof is in a range of from 0° to 40° in a direction of a centrifugal force of said upper balance weight with respect to a direction in which said orbiting shaft receives a gas compression load, and said main shaft has an initial angle of relative inclination opposite to an angle of inclination which is given by said gas pressure load and the centrifugal force of said upper balance weight.

2. A scroll type compressor as claimed in claim 1, wherein cylindrical surfaces of said rotor shaft section and said auxiliary shaft section are eccentric from the cylindrical surface of said main shaft section.

3. A scroll type compressor as claimed in claim 1, wherein said auxiliary bearing is a roller bearing.

4. A scroll type compressor as claimed in claim 2, wherein said auxiliary bearing is a roller bearing.

5. The scroll type compressor of claim 1, wherein the cylindrical surface of said auxiliary shaft section is eccentric from a cylindrical surface of said rotor shaft section.

6. The scroll type compressor of claim 5, wherein said auxiliary bearing is a roller bearing.

* * * * *